US011571833B2

(12) United States Patent
Yin et al.

(10) Patent No.: US 11,571,833 B2
(45) Date of Patent: Feb. 7, 2023

(54) MOLD DEVICE FOR MOLDING A WAFFLE SLAB AND METHOD OF MANUFACTURING A WAFFLE SLAB HAVING CHAMFERS

(71) Applicant: RUENTEX ENGINEERING & CONSTRUCTION CO., LTD., Taipei (TW)

(72) Inventors: Samuel Yin, Taipei (TW); Kun-Jung Shu, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 251 days.

(21) Appl. No.: 17/038,474

(22) Filed: Sep. 30, 2020

(65) Prior Publication Data

US 2021/0008758 A1 Jan. 14, 2021

Related U.S. Application Data

(63) Continuation of application No. 15/813,349, filed on Nov. 15, 2017, now abandoned.

(30) Foreign Application Priority Data

Sep. 6, 2017 (TW) ..... 106130471

(51) Int. Cl.
*B28B 7/00* (2006.01)
*B28B 23/04* (2006.01)
(Continued)

(52) U.S. Cl.
CPC ..... *B28B 7/0014* (2013.01); *B28B 7/0055* (2013.01); *B28B 7/164* (2013.01);
(Continued)

(58) Field of Classification Search
CPC ..... B28B 7/0014; B28B 7/186; B28B 7/164; B28B 23/024; B28B 7/0055; B28B 23/06;
(Continued)

(56) References Cited

U.S. PATENT DOCUMENTS 3,084,910 A * 4/1963 Allers ..... B28B 23/043 52/223.13
4,181,286 A * 1/1980 Van Doren ..... B28B 7/06 249/82
(Continued)

FOREIGN PATENT DOCUMENTS

CN 2828182 * 10/2006
TW 200637703 A 11/2006
(Continued)

OTHER PUBLICATIONS

Translation of TW-277498-B1 (Year: 2007).*
Translation of CN2828182 (Year: 2006).*

*Primary Examiner* — Leith S Shafi
(74) *Attorney, Agent, or Firm* — Juan Carlos A. Marquez; Marquez IP Law Office, PLLC

(57) ABSTRACT

The present disclosure is related to a mold device for molding a waffle slab, wherein a plurality of connecting structures made of steel bars protrude from the sides of the waffle slab, the mold device comprising: a plurality of steel molds provided at both sides of each of the plurality of connecting structures and surrounding the waffle slab, each of the plurality of steel molds having a top surface, which has a hole therein; a plurality of auxiliary devices respectively disposed at the sides of the waffle slab and having through holes corresponding to holes in the plurality of steel molds; and a plurality of fasteners; wherein the plurality of fasteners respectively pass through the through holes of the plurality of auxiliary devices and are fixed into the holes of the plurality of steel molds so that each of the plurality of
(Continued)

auxiliary device transversely connects the top surfaces of the plurality of steel molds.

10 Claims, 3 Drawing Sheets

(51) Int. Cl.
*B28B 23/06* (2006.01)
*B28B 23/02* (2006.01)
*B28B 7/16* (2006.01)
*B28B 7/18* (2006.01)

(52) U.S. Cl.
CPC ..... *B28B 7/186* (2013.01); *B28B 23/024* (2013.01); *B28B 23/043* (2013.01); *B28B 23/06* (2013.01)

(58) Field of Classification Search
CPC ..... B28B 23/043; B28B 7/0085; E04B 1/41; E04B 5/00
See application file for complete search history.

(56) References Cited

U.S. PATENT DOCUMENTS 9,169,643 B2 * 10/2015 Dryburgh ..... B28B 7/0014
2002/0092249 A1 * 7/2002 Yin ..... E04B 5/02 52/263
2004/0084603 A1 * 5/2004 Latham ..... B28B 7/02 249/188
2008/0036106 A1 * 2/2008 Warnick ..... B28B 7/0085 264/333
2009/0308005 A1 * 12/2009 Ireland ..... E04B 1/046 52/250
2012/0282025 A1 * 11/2012 French ..... B28B 23/04 404/82

FOREIGN PATENT DOCUMENTS

TW 277498 B 4/2007
TW 277498 B1 * 4/2007

* cited by examiner

MOLD DEVICE FOR MOLDING A WAFFLE SLAB AND METHOD OF MANUFACTURING A WAFFLE SLAB HAVING CHAMFERS

CROSS REFERENCE TO RELATED APPLICATIONS

This application is a Continuation Application of U.S. application Ser. No. 15/813,349 filed Nov. 15, 2017. The present application claims priority from U.S. application Ser. No. 15/813,349 filed Nov. 15, 2017, which claims priority from Taiwan Patent Application No. 106130471 filed on Sep. 6, 2017, the content of which is hereby incorporated by reference into this application.

TECHNICAL FIELD

The present disclosure is related to a mold device for molding a waffle slab and a method of manufacturing a waffle slab having chamfers.

BACKGROUND

High-tech products, such as chips, wafers or computer components, are becoming ever more sophisticated and require increasingly precise work. Therefore, clean rooms are used for keeping the production line free of contaminants that might otherwise interfere with the precision work undertaken. Waffle slabs are typically used as the floor of a clean room of a high-tech factory, such as a foundry plant. A clean room is designed to maintain positive pressure such that air with contaminants is exhausted via the holes provided in the waffle slabs. The contaminated air is then filtered and returned into the clean room.

Forming a waffle slab typically includes steps such as (a) providing steel molds; (b) cleaning the steel molds; (c) disposing a plurality of inner molds in the space formed by the steel molds; (d) disposing steel bar cages between the plurality of inner molds, and between the plurality of inner molds and the steel molds; (e) pouring concrete into the space; (f) waiting for initial condensation of the concrete; (g) polishing the concrete surface; and (h) releasing the steel molds from the concrete surfaces after the final condensation of the concrete. During the steps of pouring and condensation of concrete, the steel molds tend to be outwardly deformed due to the lateral pressures applied to the molds, which are generated by the weight and the collapse characteristic of the concrete in a liquid state or a quasi-liquid state. Thus, the waffle slab molded by the steel molds will have deformed concrete surfaces. In particular, the middle steel molds need to resist the largest lateral pressures generated from the concrete in a liquid state or a quasi-liquid state and thus deform the most. Accordingly, the formed waffle slab tends to have slightly curved and uneven sides, which will narrow the space between adjacent waffle slabs and affect the installation of the beams to be disposed therebetween. In addition, the edges of the thus-formed conventional waffle slab have sharp right-angled edges which may result in undesired cracks of the waffle slab caused by collisions during the subsequent transportation of the waffle slab. The undesired cracks may extend to the inside of the waffle slab and expose the internal structure of the waffle slab and reduce its strength.

In view of the above-mentioned problems of the conventional techniques, there is an urgent need for a mold device capable of forming a waffle slab having flat sides and a method of forming suitable chamfers on the edge of the waffle slab by using the mold device.

SUMMARY

The following summarizes some aspects of the present disclosure to provide a basic understanding of the technology discussed. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a summary form as a prelude to the more detailed description that is presented later.

A first aspect of the present disclosure provides a mold device for molding a waffle slab, wherein a plurality of connecting structures protrude from four sides of the waffle slab. The mold device comprises: a plurality of steel molds provided on both sides of each of the plurality of connecting structures and surrounding the waffle slab, each of the plurality of steel molds having a top surface that has at least one hole therein; a plurality of auxiliary devices respectively disposed around four sides of the waffle slab and having through holes corresponding to holes of the plurality of steel molds; and a plurality of fasteners; wherein the plurality of fasteners respectively pass through the through holes of the plurality of auxiliary devices and are fixed into the holes of the plurality of steel molds so that each of the plurality of auxiliary devices transversely connects the top surfaces of the plurality of steel molds.

In a second aspect of the present disclosure according to the first aspect, each of the plurality of auxiliary devices comprises an inclined surface facing the waffle slab, the inclined surface extending inwardly from an edge of the top of an auxiliary device to an edge of the bottom of the auxiliary device for forming a chamfer on a corresponding corner of the waffle slab.

In a third aspect of the present disclosure according to the second aspect, each of the plurality of auxiliary devices comprises a first flat upper surface adjacent to the waffle slab, the first flat upper surface and the inclined surface forming an angle of about 45 degrees.

In a fourth aspect of the present disclosure according to the third aspect, the first flat upper surface of each of the plurality of auxiliary devices is substantially flush with the top of the waffle slab.

In a fifth aspect of the present disclosure according to the fourth aspect, each of the plurality of auxiliary devices includes a second flat upper surface that is more distant from the waffle slab than the first flat upper surface, the second flat upper surface being next to the first flat upper surface and lower than the first flat upper surface.

In a sixth aspect of the present disclosure according to the fifth aspect, the through holes of each of the plurality of auxiliary devices are disposed in the second flat upper surface, and the top of each of the fasteners located in the through holes is substantially flush with the first flat upper surface or is slightly lower than the first flat surface.

In a seventh aspect of the present disclosure according to the first aspect, each of the plurality of fasteners is a screw and the at least one hole of each of the plurality of steel molds is threaded so that the screw is threaded with the at least one hole of each of the plurality of steel molds.

In an eighth aspect of the present disclosure according to the first aspect, each of the plurality of auxiliary devices has a flat bottom engaged with the corresponding top surfaces of the plurality of steel molds.

In a ninth aspect of the present disclosure according to the first aspect, the width (W) of each of the plurality of auxiliary devices is around 20 cm and the thickness (T) of each of the plurality of auxiliary devices ranges from 2 cm to 3 cm.

In a tenth aspect of the present disclosure according to the first aspect, the mold device further comprises a plurality of elongated strengthening structures, each of the plurality of elongated strengthening structures being disposed outside of the plurality of steel molds that are disposed outside of the four sides of the waffle slab, each of the plurality of elongated strengthening structures bridging the plurality of steel molds, the plurality of elongated strengthening structures being interconnected at their ends to hold and support the plurality of steel molds against an outward pressure generated by the concrete in the waffle slab before it reaches a predetermined strength.

An eleventh aspect of the present disclosure provides a method of manufacturing a waffle slab having chamfers, comprising: providing a reinforcement cage used for the waffle slab, wherein the reinforcement cage is provided with a plurality of connecting structures spaced apart from each other at the sides of the reinforcement cage; providing a plurality of steel molds outside the outer edges of the reinforcement cage and between the plurality of connecting structures to form a space for pouring concrete therein; each of the plurality of steel molds having a top surface that has at least one hole; providing a plurality of auxiliary devices each having through holes corresponding to holes of the plurality of steel molds; providing a plurality of fasteners; passing the plurality of fasteners through the through holes of the plurality of auxiliary devices and fixing the plurality of fasteners into the holes of the top surfaces of the plurality of steel molds so that each of the plurality of auxiliary devices transversely connects the top surfaces of the plurality of steel molds; pouring concrete into the space; and removing the fasteners, the auxiliary devices and the steel molds after the concrete reaches a predetermined strength.

In a twelfth aspect of the present disclosure according to the eleventh aspect, each of the plurality of auxiliary devices comprises an inclined surface facing the waffle slab, the inclined surface extending inwardly from an edge of the top of an auxiliary device to an edge of the bottom of the auxiliary device for forming a chamfer on a corresponding corner of the waffle slab.

In a thirteenth aspect of the present disclosure according to the twelfth aspect, each of the plurality of auxiliary devices comprises a first flat upper surface adjacent to the waffle slab, the first flat upper surface and the inclined surface forming an angle of about 45 degrees.

In a fourteenth aspect of the present disclosure according to the thirteenth aspect, the first flat upper surface of each of the plurality of auxiliary devices is substantially flush with the top of the waffle slab.

In a fifteenth aspect of the present disclosure according to the fourteenth aspect, the through holes of each of the plurality of auxiliary devices are disposed in the second flat upper surface, and the top of each of the fasteners located in the through holes is substantially flush with the first flat upper surface or is slightly lower than the first flat surface.

In a sixteenth aspect of the present disclosure according to the eleventh aspect, each of the plurality of fasteners is a screw and the at least one hole of each of the plurality of steel molds is threaded so that the screw is threaded with the at least one hole of each of the plurality of steel molds.

In a seventeenth aspect of the present disclosure according to the eleventh aspect, the method further comprises: providing a plurality of elongated strengthening structures; disposing the plurality of elongated strengthening structures outside of the plurality of steel molds that are disposed outside of the four sides of the waffle slab, so that the plurality of elongated strengthening structures bridge the plurality of steel molds; and interconnecting the ends of the plurality of elongated strengthening structures to support and hold the plurality of steel molds against an outward pressure generated by the concrete in the waffle slab before it reaches the predetermined strength.

Based on the above aspects, the present disclosure provides a mold device capable of forming a waffle slab having flat sides and a method of forming suitable chamfers on the edge of the waffle slab by using the mold device.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Figure 1:
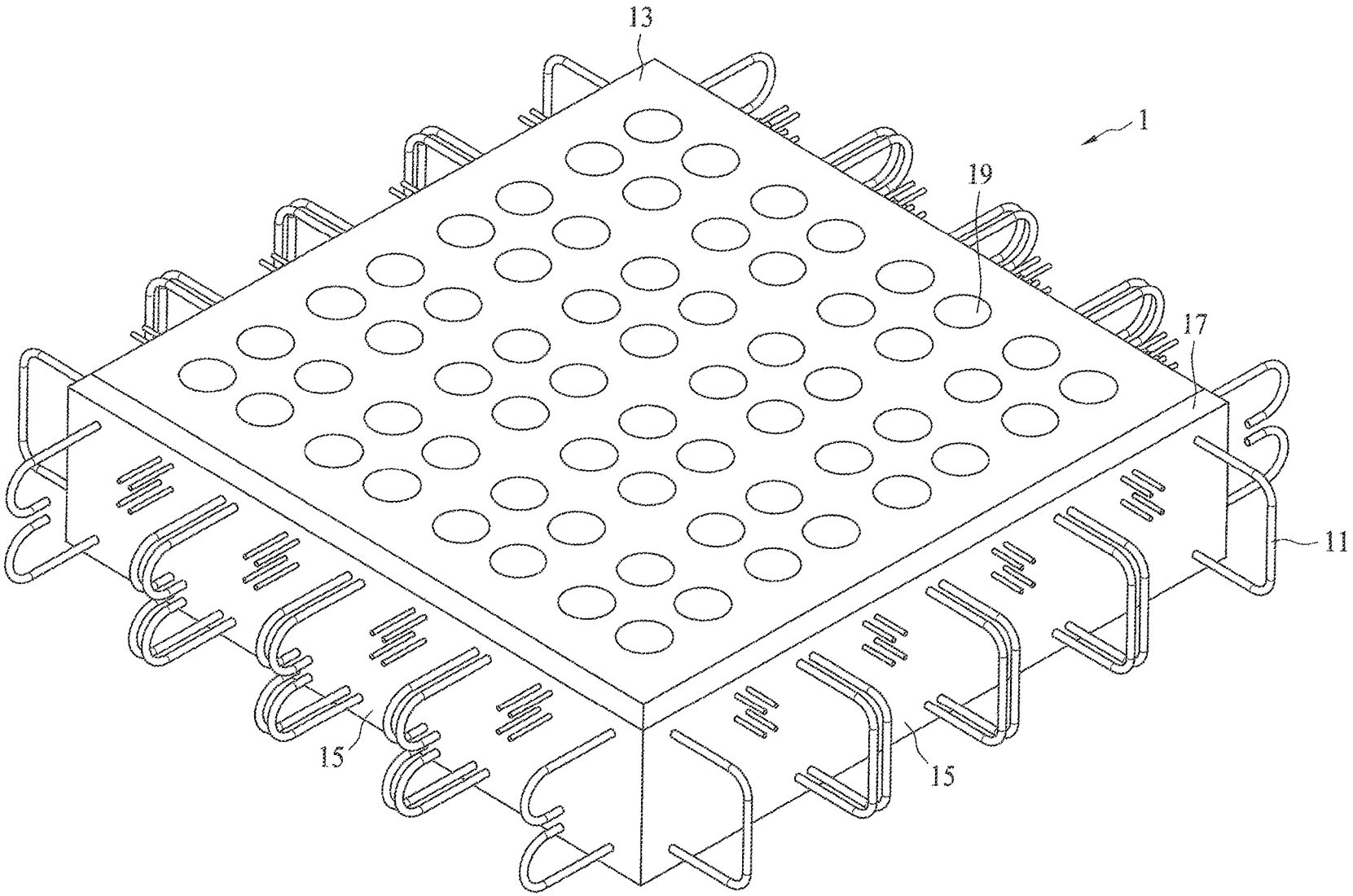
FIG. 1 illustrates a waffle slab formed by the mold device according to an embodiment of the present disclosure.

FIG. 1 illustrates a waffle slab formed by the mold device according to an embodiment of the present disclosure. The waffle slab 1 comprises concrete structure 13 and reinforcement cages in the concrete structure 13. Each of the reinforcement cages has a plurality of bound steel bars. A plurality of through holes 19 are formed in the waffle slab 1 with inner molds (not shown). In a clean room of a high-tech plant where the waffle slab 1 is to be installed, contaminants will be exhausted via the through holes 19 provided in the waffle slab 1. A plurality of connecting structures 11, which are preferably made of steel bars that are end portions of the reinforcement cages, protrude from four sides 15 of the waffle slab 1. The connecting structures 11 are used to engage with subsequently-installed beams and/or pillars for a smooth and rapid formation of a roof or a floor of the plant. As shown in FIG. 1, the waffle slab 1 formed by the mold of the present disclosure has flat sides 15 and has suitable chamfers 17 along the edges of the waffle slab 1.

Figure 2:
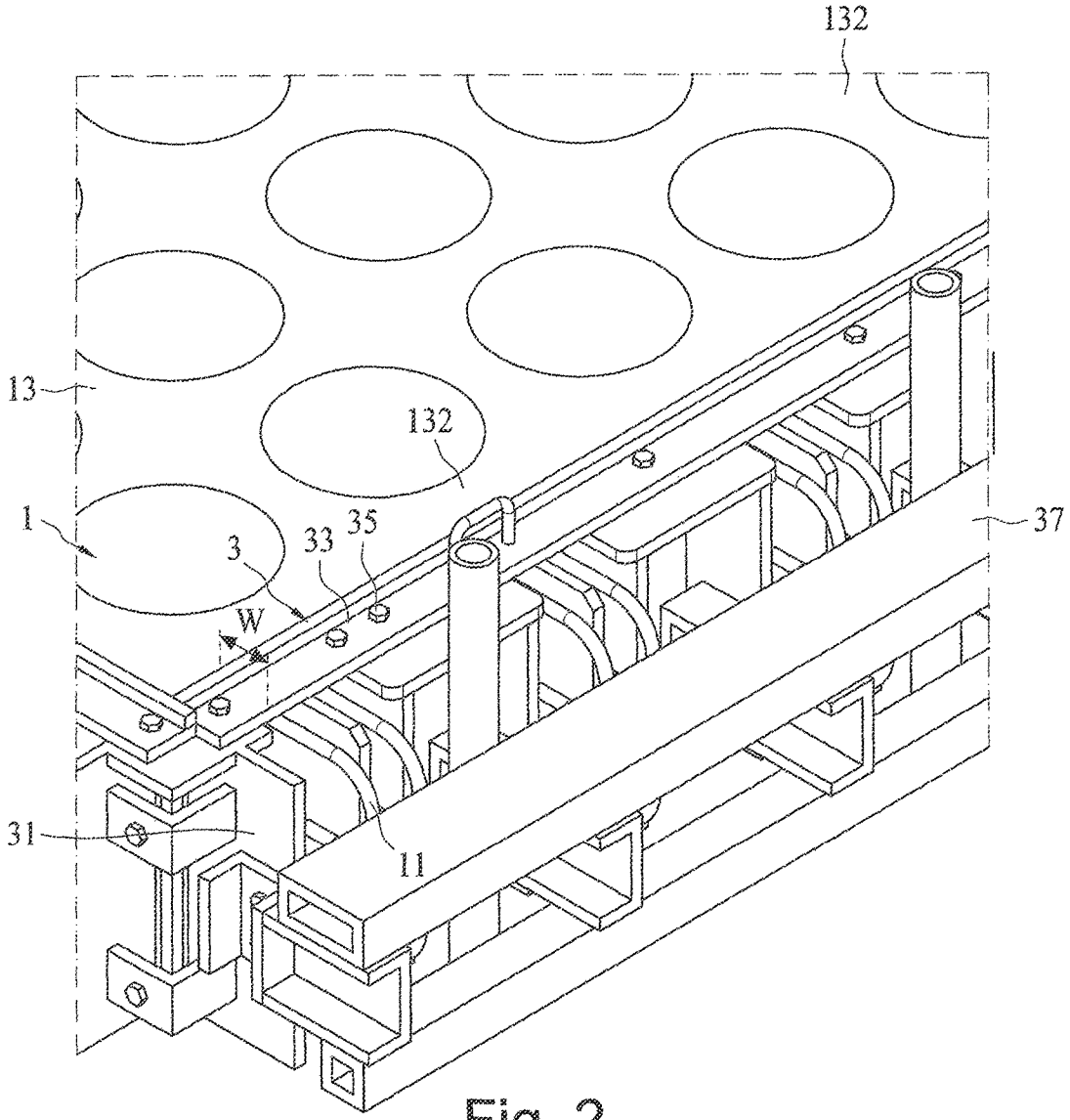
FIG. 2 illustrates the mold device according to an embodiment of the present disclosure.
Figure 3:
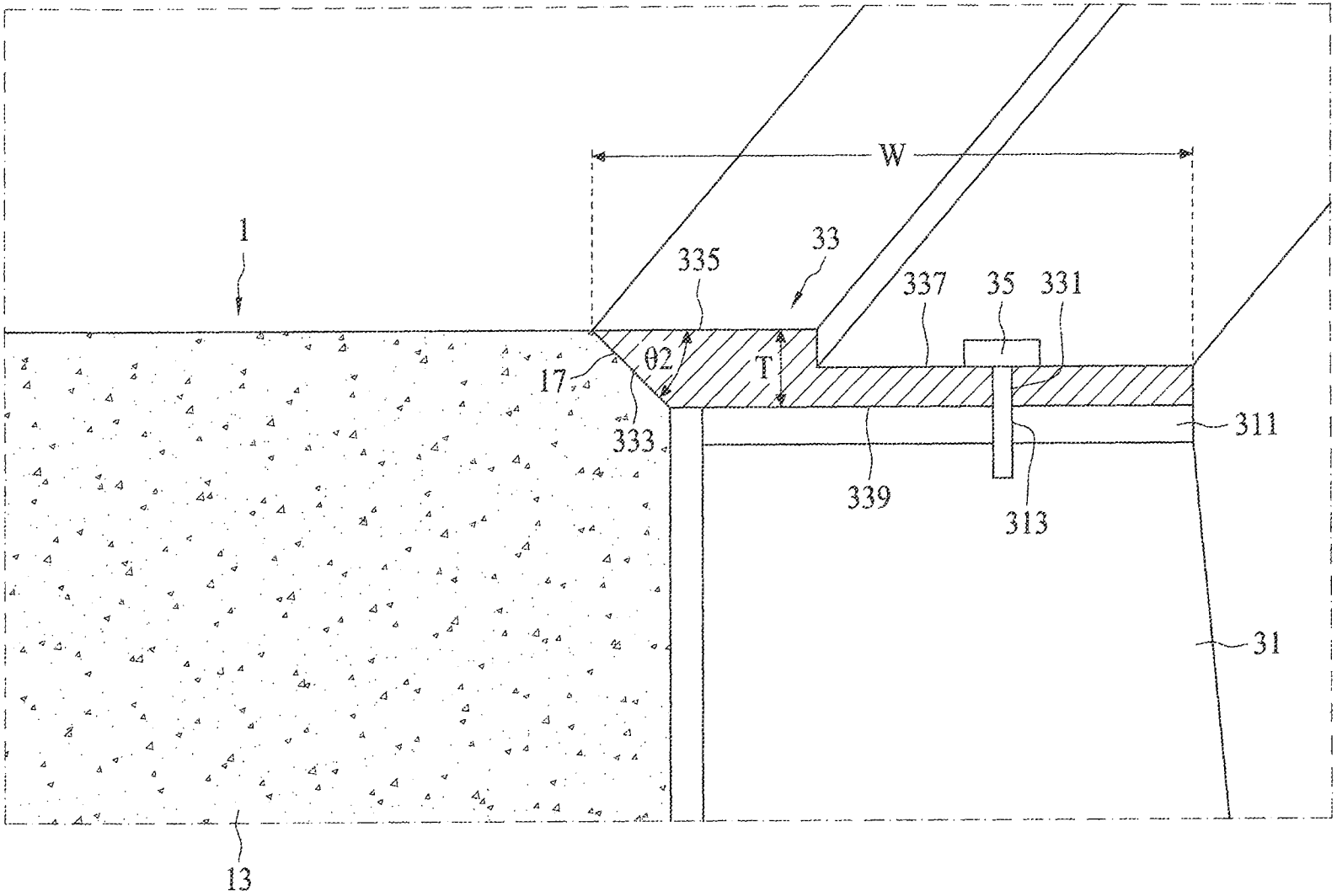
FIG. 3 illustrates a cross-sectional view of the mold device according to an embodiment of the present disclosure.

FIG. 2 illustrates the mold device of the present disclosure. FIG. 3 illustrates a cross-sectional view of the mold device of the present disclosure.

Please refer to FIGS. 1 to 3. The present disclosure provides a mold device 3 for molding a waffle slab 1 having flat sides 15 which are substantially perpendicular to the ground after installation. The mold device 3 is preferably made of steel. Suitable chamfers 17 are provided on the upper edges of the sides 15 of the waffle slab 1. The waffle slab 1 shown in FIGS. 2 and 3 is in a state where the concrete in the concrete structure 13 has not yet completely solidified or hardened and the mold device 3 has not been removed from the surfaces of the concrete structure 13.

As shown in FIGS. 2 and 3, the mold device 3 comprises a plurality of steel molds 31, a plurality of fasteners 35 and a plurality of auxiliary devices 33. The steel molds 31 are used to support and mold the unsolidified waffle slab 1. Prior to formation of the waffle slab 1, the assembled steel molds 31 provide a space therein for concrete to be poured into the space and reinforcement cases to be placed therein to form the concrete structure 13. The steel molds 31 are provided on both sides of each of the plurality of connecting structures 11 and surround the sides 15 of the waffle slab 1. Each of the plurality of steel molds 31 has a top surface 311. The top surface 311 has at least one hole 313 therein for receiving a corresponding fastener 35.

The auxiliary devices 33 are respectively disposed around upper portions of the four sides 15 of the waffle slab 1. The auxiliary devices 33 abut against and align with the four sides 15 of the waffle slab 1. Each of the plurality of auxiliary devices 33 has a flat bottom 339 contacting the corresponding top surfaces 311 of the steel molds 31. Each of the auxiliary devices 33 has through holes 331 corresponding to the holes 313 of the steel molds 31. Specifically, the fasteners 35 respectively pass through the through holes 331 of the auxiliary devices 33 and are fixed into the holes 313 of the steel molds 31 so that each of the auxiliary devices 33 transversely connects the top surfaces 311 of its adjacent steel molds 31. Such auxiliary devices 33 that transversely bridge adjacent steel molds 31 increase the connection strength between the steel molds 31. With the auxiliary devices 33, during the steps of pouring and condensation of concrete, the steel molds 31 obtain sufficient strength to support the lateral pressure generated by the weight and the collapse characteristic of the concrete in the liquid state, and the steel molds 31 do not deform or expand outward. Thus, after the removals of the steel molds 13 and the auxiliary devices 33 from the concrete surfaces of the concrete structure 13, the waffle slab 1 will have desired flat sides 15.

As shown in FIG. 3, each of the auxiliary devices 33 is a substantially rectangular steel plate. The width (W) of each of the auxiliary devices 33 is around 20 cm and the thickness (T) thereof ranges from 2 cm to 3 cm. The size of the auxiliary device 33 can be adjusted according to the size and shape of the steel molds 31. In another embodiment, the auxiliary devices 33 are integrally formed with the steel molds 31. As shown in FIG. 3, each of the auxiliary devices 33 comprises an inclined surface 333 facing the waffle slab 1. The inclined surface 333 extends inward from the edge of the top of the auxiliary device 33 to the edge of the bottom of the auxiliary device 33 to form a chamfer 17 on a corresponding corner of the waffle slab 1. Each of the auxiliary devices 33 comprises a first flat upper surface 335 adjacent to the waffle slab 1. The first flat upper surface 335 and the inclined surface 333 form an angle θ2 of about 45 degrees.

As shown in FIGS. 2 and 3, the first flat upper surface 335 of each of the auxiliary devices 33 is substantially flush with the top of the waffle slab 1. Each of the auxiliary devices 33 includes a second flat upper surface 337 that is more distant from the waffle slab 1 than the first flat upper surface 335. The second flat upper surface 337 is next to the first flat upper surface 335 and is lower than the first flat upper surface 335. The through holes 331 of each of the auxiliary devices 33 are disposed in the second flat upper surface 337. The top of the fasteners 35 located in the through holes 331 is substantially flush with the first flat upper surface 335 or is slightly lower than the first flat surface 335.

The above arrangement brings benefits to the subsequent polishing of the waffle slab 1. In order to flatten the top surface 132 of the concrete structure 13, a polishing tool (such as a troweling machine and/or a polishing machine) is commonly used to polish the top surface 132 of the concrete structure 13 so as to flatten the top surface 132. In addition, the feature that the top surface of the concrete structure 13 is flush with the auxiliary devices 33 described above allows the polishing tool to operate smoothly on the top portion surface 132 of the concrete 13 without being obstructed by any protrusion or interruption, so that the area on the concrete structure 13 near the auxiliary devices 33 can be fully polished. Moreover, the fasteners 35 lying flush with or slightly lower than the first flat upper surface 335 may prevent the fasteners 35 from colliding with the polishing tool during the polishing process.

In one embodiment, the fastener 35 is a threaded screw. The at least one hole 313 of each of the steel molds 31 is threaded so that the screw is threaded with the at least one hole 313 of each of the steel molds 31 for achieving the strong connection between the auxiliary devices 33 and the steel molds 31. In another embodiment, the fastener 35 is a rivet. The auxiliary device 33 is secured to the top of the steel mold 31 by deformation of the rivet.

In a further embodiment, the steel mold 3 further has a base (not shown in the drawings) provided beneath the steel mold 31 to form a space for placing reinforcement cages and inner molds therein, and for being filled with concrete. With regard to the details of the base, the technical content of Taiwan Patent No. 1277498 is entirely incorporated herein by reference and is not repeated.

As shown in FIG. 2, the mold device 3 further comprises a plurality of elongated strengthening structures 37. Each of the elongated strengthening structures 37 is disposed outside of the steel molds 31 that are disposed outside of the four sides of the waffle slab 1. Each of the elongated strengthening structures 37 bridges the steel molds 31. The plurality of elongated strengthening structures 37 are interconnected at their ends to hold and support the steel molds 31 against an outward pressure generated by the concrete that has not reached a predetermined strength to form the concrete structure 13. More specifically, the elongated strengthening structures 37 bridge the base portions that extend from the bottom of the steel molds 31, which provides the steel molds 31 with sufficient strength and prevents the steel molds 31 from deforming.

In order to mold the waffle slab as shown in FIG. 1, the present disclosure further provides a method of manufacturing a waffle slab having flat sides 15 and suitable chamfers 17. When reading the manufacturing method below, please refer to the numerals of the elements shown in FIGS. 1 to 3. One embodiment of the manufacturing method of the present disclosure includes the following steps:

A. Step 1: Providing inner molds and reinforcement cages:

1. Placing a plurality of inner molds (not shown) for formation of the through holes in the waffle slab on a working platform.
2. Placing reinforcement cages on the working platform and between the inner molds, wherein the reinforcement cages are provided with a plurality of connecting structures 11 spaced apart from each other at the sides of the reinforcement cage. The connecting structures 11 are used to engage with subsequently-installed beams and/or pillars.

B. Step 2: Assembling the mold devices 3:

1. Providing a plurality of steel molds 31 outside the outer edges of the bodies of the reinforcement cages and between the plurality of connecting structures 11 to form a space therein. Each of the steel molds 31 has a top surface 311 that has at least one hole 313.
2. Providing a plurality of auxiliary devices 33 wherein each of the auxiliary devices 33 has through holes 331 corresponding to holes 313 in the steel molds 31.
3. Providing a plurality of fasteners 35.
4. Passing the fasteners 35 through the through holes 331 of the auxiliary devices 33 and fixing the fasteners 35 into the holes 313 of the top surfaces 311 of the steel molds 31 so that each of the auxiliary devices 33 transversely connects the top surfaces 311 of adjacent steel molds 31.
5. Applying lubricating oil on the inside of the mold devices 3 for facilitating the removal of the steel devices 3 after the concrete that will be poured has solidified (i.e., the concrete structure 13 is formed).
6. Using rubber strips or rubber sheets (not shown in the drawings) to cover the gaps between the steel molds 31 and the connecting structures 11 to prevent the concrete that will be poured from flowing out of the space.

C. Step 3: Pouring concrete into the space:

Pouring concrete into the space and waiting for the concrete to reach a predetermined strength to form the concrete structure 13.

D. Step 4: Flattening the surface of the concrete structure 13.

After the concrete reaches a predetermined strength to form the concrete structure 15, using a polishing tool to polish the top surface 132 of the concrete structure 13.

E. Step 5: Removing the fasteners 35, the auxiliary devices 33 and the steel molds 31:

After the concrete reaches a predetermined strength to form the concrete structure 13 and the polishing process is finished, removing the fasteners 35, the auxiliary devices 33 and the steel molds 31 from the concrete surfaces of the concrete structure 13.

Through the above steps, the waffle slab 1 formed by the reinforcement cage and the concrete structure 13 is obtained. For the structural details of the mold device 3 used in the above-mentioned method, please refer to FIGS. 2 and 3 along with their respective narratives herein.

In sum, the auxiliary devices 33 of the present disclosure increase the connection strength between the adjacent steel molds 31 at both sides of the connecting structures 11. Accordingly, during the steps of pouring concrete into the steel molds 31, the steel molds 31 would not deform or expand outward due to the lateral pressure generated by the weight and the collapse characteristic of the concrete in a liquid state. As a result, the waffle slab 1 made by the mold device 3 of the present disclosure has flat sides. In addition, the auxiliary devices 33 of the present disclosure form chamfers 17 on corresponding upper corners of the waffle slab 1, which prevent cracks from occurring if the waffle slab 1 collides with some object during transportation. Furthermore, the chambers 17 prevent a worker from cutting his/her hands.

As those of some skill in this art will by now appreciate and depending on the particular application at hand, many modifications, substitutions and variations can be made in and to the materials, apparatus, configurations and methods of use of the devices of the present disclosure without departing from the spirit and scope thereof. In light of this, the scope of the present disclosure should not be limited to that of the particular embodiments illustrated and described herein, as they are merely examples thereof, but rather, should be fully commensurate with that of the claims appended hereafter and their functional equivalents.

What is claimed is:

1. A construction structure comprising:

a waffle slab, comprising: a plurality of through holes therein and a plurality of connecting structures protruding from four sides of the waffle slab, a protruding portion of each of the plurality of connecting structures being U-shaped or hook-shaped;

a mold device comprising:

a plurality of steel molds surrounding the waffle slab, each of the plurality of steel molds having a top surface that has at least one hole therein, the protruding portion of each of the plurality of connecting structures being sandwiched by two corresponding steel molds;

a plurality of auxiliary devices respectively disposed around four sides of the waffle slab and having through holes corresponding to holes of the plurality of steel molds; and a plurality of fasteners;

wherein the plurality of fasteners respectively pass through the through holes of the plurality of auxiliary devices and are fixed into the holes of the plurality of steel molds so that each of the plurality of auxiliary devices transversely connects the top surfaces of the plurality of steel molds.

2. The construction structure of claim 1, wherein each of the plurality of auxiliary devices comprises an inclined surface facing the waffle slab, the inclined surface extending inwardly from an edge of the top of an auxiliary device to an edge of the bottom of the auxiliary device for forming a chamfer on a corresponding corner of the waffle slab.

3. The construction structure of claim 2, wherein each of the plurality of auxiliary devices comprises a first flat upper surface adjacent to the waffle slab, the first flat upper surface and the inclined surface forming an angle of about 45 degrees.

4. The construction structure of claim 3, wherein the first flat upper surface of each of the plurality of auxiliary devices is substantially flush with the top of the waffle slab.

5. The construction structure of claim 4, wherein each of the plurality of auxiliary devices includes a second flat upper surface that is more distant from the waffle slab than the first flat upper surface, the second flat upper surface being next to the first flat upper surface and lower than the first flat upper surface.

6. The construction structure of claim 5, wherein the through holes of each of the plurality of auxiliary devices are disposed in the second flat upper surface, and the top of each of the fasteners located in the through holes is substantially flush with the first flat upper surface or is lower than the first flat surface.

7. The construction structure of claim 1, wherein each of the plurality of fasteners is a screw and the at least one hole of each of the plurality of steel molds is threaded so that the screw is threaded with the at least one hole of each of the plurality of steel molds.

8. The construction structure of claim 1, wherein each of the plurality of auxiliary devices has a flat bottom engaged with the corresponding top surfaces of the plurality of steel molds.

9. The construction structure of claim 1, wherein the width (W) of each of the plurality of auxiliary devices is around 20 cm and the thickness (T) of each of the plurality of auxiliary devices ranges from 2 cm to 3 cm.

10. The construction structure of claim 1, further comprising a plurality of elongated strengthening structures, each of the plurality of elongated strengthening structures being disposed outside of the plurality of connecting structures protruding from the four sides of the waffle slab, each of the plurality of elongated strengthening structures bridging the plurality of steel molds, the plurality of elongated strengthening structures being interconnected at their ends to hold and support the plurality of steel molds against an outward pressure generated by the concrete in the waffle slab before it reaches a predetermined strength.

* * * * *